US007818841B2

(12) United States Patent
Happel

(10) Patent No.: US 7,818,841 B2
(45) Date of Patent: Oct. 26, 2010

(54) ANTIDECUBITAL UNDERLAY PAD AND BED PAD DESIGN COMPRISING AN ANTIDECUBITAL UNDERLAY PAD

(75) Inventor: Daniela Happel, Siegertsbrunn (DE)

(73) Assignee: Oped AG, Steinhausen (CH)

( * ) Notice: Subject to any disclaimer, the term of this patent is extended or adjusted under 35 U.S.C. 154(b) by 0 days.

(21) Appl. No.: 12/065,061

(22) PCT Filed: Jul. 24, 2006

(86) PCT No.: PCT/EP2006/007274

§ 371 (c)(1),
(2), (4) Date: Jun. 27, 2008

(87) PCT Pub. No.: WO2007/025611

PCT Pub. Date: Mar. 8, 2007

(65) Prior Publication Data

US 2009/0019642 A1 Jan. 22, 2009

(30) Foreign Application Priority Data

Aug. 31, 2005 (DE) ..... 10 2005 041 520

(51) Int. Cl.
*A61G 7/057* (2006.01)

(52) U.S. Cl. ..... 5/691; 5/702; 5/655.4

(58) Field of Classification Search ..... 5/691, 5/702, 724, 736, 737, 740, 901, 911, 644.4
See application file for complete search history.

(56) References Cited

U.S. PATENT DOCUMENTS 3,459,179 A * 8/1969 Olesen ..... 601/134
5,475,881 A * 12/1995 Higgins et al. ..... 5/737
5,564,141 A * 10/1996 Anderson ..... 5/668
5,881,409 A * 3/1999 Pearce ..... 5/702
6,058,536 A * 5/2000 Henry ..... 5/691
6,857,151 B2 * 2/2005 Jusiak et al. ..... 5/655.4
6,966,090 B2 * 11/2005 McClintock et al. ..... 5/706
7,356,864 B1 * 4/2008 Delfs ..... 5/691

FOREIGN PATENT DOCUMENTS

EP 0 412 563 B1 2/1991
GB 2 197 192 A 5/1988
GB 2 319 721 A 6/1998
WO WO 03/091014 A1 11/2003

OTHER PUBLICATIONS

PCT Search Report for PCT/EP2006/007274, mailed Jan. 19, 2007, 2 pages.

* cited by examiner

*Primary Examiner*—Michael Trettel
(74) *Attorney, Agent, or Firm*—Blakely, Sokoloff, Taylor & Zafman LLP

(57) ABSTRACT

An antidecubital underlay pad (10) having a receiving casing with a top side of the casing and a bottom side of the casing, the casing being segmented along a plurality of segmentation axes (13) to form underlay segments (12), such that the underlay segments are provided with a molded body filling comprising a plurality of molded bodies and are bordered by segmentation lines running along the segmentation axes, wherein the segmentation lines have multiple changes in direction in their course along the segmentation axes (13) and at least the top side (16) of the casing is designed to be elastic at least in a supporting area and is prestressed by the molded body filling (20).

6 Claims, 3 Drawing Sheets

ANTIDECUBITAL UNDERLAY PAD AND BED PAD DESIGN COMPRISING AN ANTIDECUBITAL UNDERLAY PAD

CROSS-REFERENCE TO OTHER APPLICATIONS

This is a National Phase of International Application No. PCT/EP2006/007274, filed on Jul. 24, 2006, which claims priority from German Patent Application No. 10 2005 041 520.2, filed on Aug. 31, 2005.

BACKGROUND OF THE INVENTION

The invention relates to an antidecubital underlay pad having a receiving casing with a top side of the casing and a bottom side of the casing, the casing being segmented along a plurality of segmentation axes to form underlay segments, such that the underlay segments are provided with a molded body filling comprising a plurality of molded bodies and are bordered by segmentation lines running along the segmentation axes. In addition, the invention relates to a bed pad design comprising such an antidecubital underlay pad.

Antidecubital underlay pads of the type defined in the introduction are used in particular for supporting patients who are bedridden for a long period of time to counteract the development of pressure sores. European Patent EP 0 412 563 B1 describes an antidecubital underlay pad comprised of individual elements that can be handled independently of one another and are connected to one another via connecting elements designed as buttons, for example, arranged in the edge areas of the elements. Points of discontinuity, which can in turn facilitate the development of unwanted pressure sores, are formed due to the connecting areas of the individual elements.

SUMMARY OF THE INVENTION

The object of the present invention is therefore to propose an antidecubital underlay pad, which will allow uniform support of a bedridden patient over the entire supporting surface, thus counteracting the development of pressure sores.

To solve this problem, the inventive antidecubital underlay pad has the features of claim 1 and a bed pad design according to claim 11.

The inventive antidecubital underlay pad has segmentation lines which have multiple changes in direction in their course along the segmentation axes. In addition, with the inventive antidecubital underlay pad, the top side of the casing is designed to be elastic at least in a supporting area and is prestressed by the molded body filling.

Because of the multiple changes in direction of the segmentation lines, adjacent areas of the underlay segments form intermeshing tongue-shaped protruding areas and recessed areas formed in the manner of indentations. This ensures that with any changes in the position of a bedridden patient in two axes in the plane of the antidecubital underlay pad, areas of the adjacent underlay segments can be shifted above one another, so that a cushioning effect of the antidecubital underlay pad is provided even in the area of the segmentation axes and/or segmentation lines in any case. The molded bodies of the molded body filling cooperate with the top side of the casing which is designed to be elastic, producing a resilient effect especially in areas of overlapping underlay segments, so that, first of all, the development of depressions in the pad is prevented, while on the other hand, the respective position of the patient is supported in a stabilizing manner.

In a preferred embodiment of the antidecubital underlay pad, the segmentation lines are arranged so they are equidistant to achieve a uniform deformation behavior over the entire surface area of the receiving casing. In some areas the segmentation lines may also be arranged in a greater density than in other areas, depending in particular on the preferred pad areas for supporting the patient.

The segmentation lines preferably have a meandering pattern, so that regardless of the direction of the shifting of the patient in the plane of the antidecubital underlay pad, the development of overlapping areas of the underlay segments is possible. If the segmentation lines have a sinusoidal course, the result is an especially regular overlapping effect along the segmentation axes.

The abovementioned advantageous resilient effect of the antidecubital underlay pad is supported in particular by the fact that the molded bodies of the molded body filling are formed by spherical particles. The spherical design of the particles supports sliding of the particles against one another without the particles being blocked with respect to one another due to their shape. In this context, of course an especially smooth surface has an advantageous effect.

If the molded bodies are designed to be elastically resilient, this makes a particular contribution toward increasing comfort in lying on the pad.

If the molded bodies are made of expanded polystyrene, the advantageous properties of elastic resilience, a spherical design and smooth particle surface are combined in a particularly advantageous manner.

It has proven to be especially advantageous if the segmentation lines are formed by linear contact areas of the top side of the casing and the bottom side of the casing, the contact areas resting against one another, because the size of the contact areas can be minimized in this way.

To also create an effect that supports the cushioning effect within the underlay segments, it is advantageous if the underlay segments have contact bridges which are arranged at a distance from the segmentation lines and are formed by contact areas of the top side of the casing and the bottom side of the casing, the contact areas resting against one another.

The advantageous effects of the antidecubital underlay pad mentioned above with regard to suppressing the development of pressure sores can be further supported by providing the receiving casing, at least in the area of the top side of the casing, with a sheet-like cover being secured in the peripheral area of the receiving casing and loosely lying there as well as having an enlarged size in an overlap area with the top side of the casing in comparison with the surface area of the top side of the casing. When moving a patient in the plane of the antidecubital underlay pad, this cover counteracts the development of shearing forces in the outer areas of the patient's tissue or skin that are exposed to pressure by the fact that, due to the enlarged state, a shifting of some areas of the cover with respect to neighboring areas of the cover is possible without tensile stresses occurring in the cover. This takes into account the known phenomenon whereby a decubital ulcer may develop not only as a result of pressure but also because of shear stresses in the tissue.

A further increase in the advantageous effects that can be achieved with the antidecubital underlay pad is made possible if the antidecubital underlay pad is integrated into a bed pad design that is provided with an intermediate layer arranged between a supporting layer and the antidecubital underlay pad, such that the intermediate layer is arranged on a structured surface of the supporting layer, forming aeration cavities in cooperation with the intermediate layer, and the intermediate layer has ventilation openings between its top side facing the antidecubital underlay pad and its bottom side facing the structured surface of the supporting layer.

The inventive bed pad design thus allows a combination of the advantageous effects of the antidecubital underlay pad with a support that allows especially effective aeration of the antidecubital underlay pad.

It has proven to be especially advantageous if the supporting layer is formed from a foam material because the supporting layer thus contributes to the development of the desired cushioning effect.

A further increase in the cushioning effect without any deleterious impairment of the ventilation effect is possible if the intermediate layer is formed by a foam material with through-holes formed therein.

The use of the bed pad design is facilitated in particular if the supporting layer and the intermediate layer arranged thereon are arranged in a layer composite which has frame parts arranged on the longitudinal and transverse sides of the intermediate layer, which frame parts in cooperation with the intermediate layer define a receiving space to receive the antidecubital underlay pad.

If in addition at least two opposing frame parts are made of foam, then a further increase in the cushioning effect is possible while at the same time securing the layer composite.

If at least two opposing frame parts have an interlinked supporting structure, then effective underventilation of the antidecubital underlay pad is made possible.

BRIEF DESCRIPTION OF THE DRAWINGS

Advantageous embodiments of the antidecubital underlay pad and the bed pad design are explained in greater detail below on the basis of the drawings in which.

DETAILED DESCRIPTION OF THE INVENTION

Figure 1:
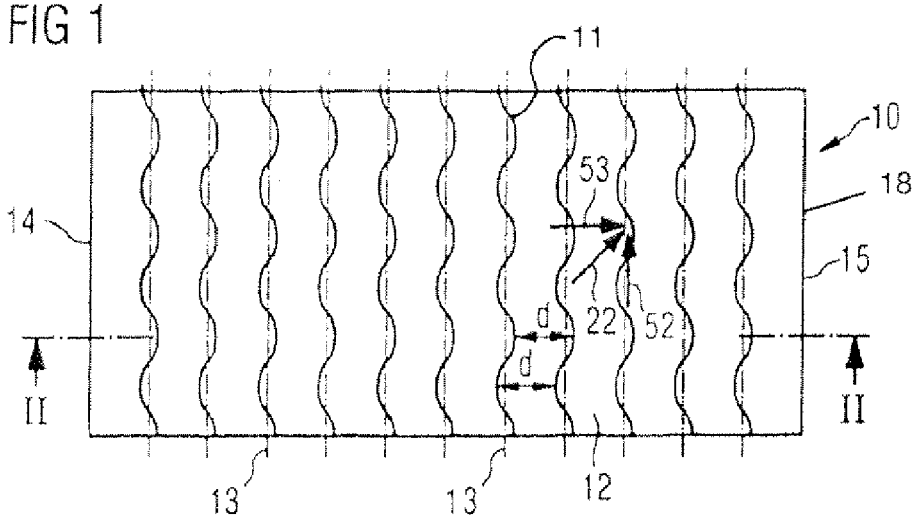
FIG. 1 shows an antidecubital underlay pad according to a first embodiment and as seen from above.

FIG. 1 shows an antidecudbital underlay pad 10 comprising a receiving casing 18, which is divided by segmentation lines 11 into a plurality of underlay segments 12.

The segmentation lines 11 bordering the underlay segments 12 at the side run along segmentation axes 13, which in the present case are aligned parallel to the transverse edges 14, 15 of the antidecubital underlay pad 10. The segmentation lines 11 have a sinusoidal pattern with a uniform distance d from one another.

Figure 2:
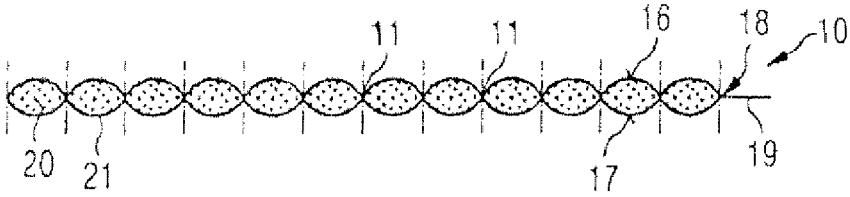
FIG. 2 shows the antidecubital underlay pad shown in FIG. 1 in a sectional diagram according to sectional line II-II.

When FIGS. 1 and 2 are seen together, the underlay segments 12 have a convex shape on both sides, as seen in cross section, such that the segmentation lines 11 are formed by linear contact areas running according to the segmentation lines 11 between the top side of the casing 16 and the bottom side of the casing 17. For example, the segmentation lines 11 may be formed by seams running accordingly.

As FIG. 2 also shows, the segmentation lines 11 are essentially arranged in a common middle plane 19 of the receiving casing 18. The individual underlay segments 12 are provided with a molded body filling 20 of elastically resilient molded bodies 21, which in the case of the exemplary embodiment shown here consist of spherical extruded polystyrene (EPS). Due to the molded body filling 20, the underlay segments 12 are forced into the abovementioned double-convex cross-sectional shape such that the underlay segments 12 can assume the lenticular design indicated in FIG. 2 up to an approximately circular shape, depending on the degree of filling.

Figure 3:
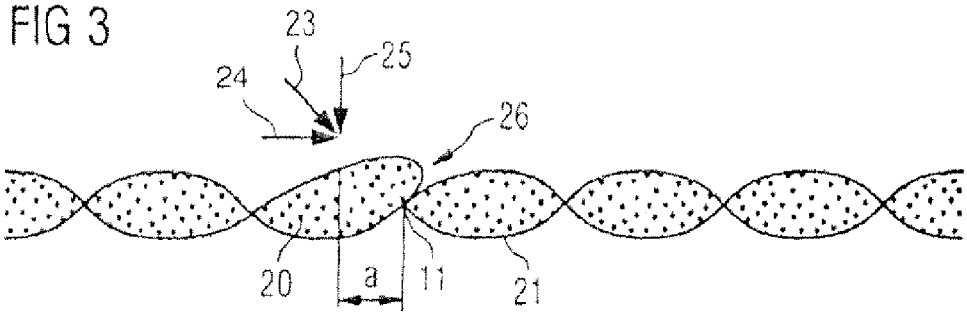
FIG. 3 shows a detailed enlargement of the sectional diagram shown in FIG. 2 to illustrate the shaping behavior.

As shown by the load arrows 22, 23 drawn into FIGS. 1 and 3, which are shown to illustrate the deformation behavior of the underlay segments 12, the course of the segmentation lines 11, which is designed to change directions here in a meandering fashion, ensures that deformation components in the transverse direction 52 and the longitudinal direction 53 of the antidecubital underlay pad 10 are always formed with any spatial orientation of the load direction, causing a shifting deformation of the underlay segments 12 with respect to one another. As illustrated by FIG. 3 on the basis of the section through the antidecubital underlay pad 10 running perpendicular to the horizontal or middle plane 19, even breaking down the load 23 into its horizontal component 24 and its vertical component 25 causes a deformation of the underlay segment 12 which is acted upon by the load 23 and this in turn leads to the development of an overlap area 26 between neighboring underlay segments 12 due to the meandering course of the segmentation line 11. A breakthrough of the top side 16 of the casing toward the bottom side 17 of the casing is even then effectively prevented if a load strikes a point on the segmentation line 11 perpendicularly because adjacent areas are always under stress at a distance a from the segmentation line 11, as shown in FIG. 3, because of the constant changes in direction of the course of the segmentation line 11. This distance a results in the development of a corresponding overlap area 26, as shown in FIG. 3. Because of the elastic design of the top side 16 of the casing, after the elimination of the load 23 there is an automatic restoring or resiliency of the overlap area 26 to restore the original contour. This restoring effect can be further emphasized by designing also the bottom side 17 of the casing to be elastic.

Figure 4:
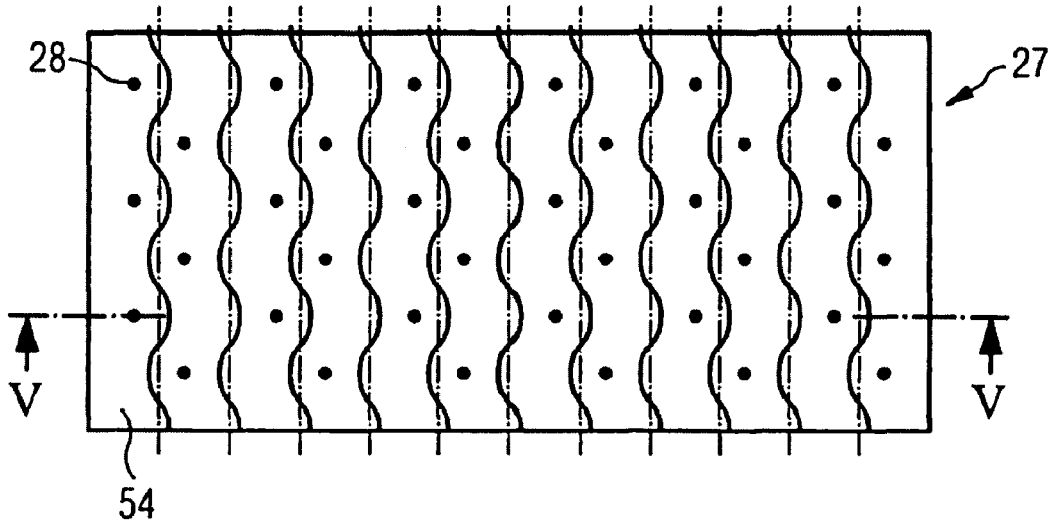
FIG. 4 shows an antidecubital underlay pad according to a second embodiment and as seen from above.
Figure 5:
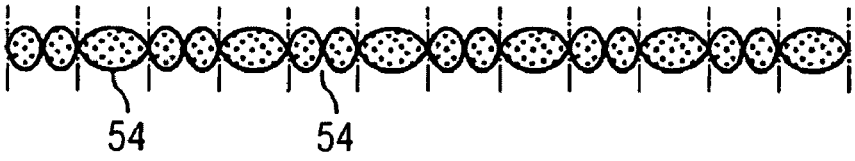
FIG. 5 shows the antidecubital underlay pad as shown in FIG. 4 in a sectional diagram according to sectional line V-V.

The embodiment of an antidecubital underlay pad 27 shown in FIGS. 4 and 5 is provided with underlay segments 54 which are provided with additional contact bridges 28 designed here approximately as points along the segmentation axes 13, at which corresponding point-shaped contact areas between the top side 16 of the casing and the bottom side 17 of the casing are formed. The contact bridges 28 allow a reduction in the volume of the underlay segments 12 intended for being filled with elastic molded bodies 21 so that the degree of filling of the underlay segments 12 which is required to create the elastic deformation property described above with special reference to FIG. 3 can also be achieved with a comparatively small amount of molded bodies 21. In addition, the contact bridges 28 counteract a redistribution of the molded bodies 21 within the underlay segments 54 and thus contribute toward preventing the development of depressions in the pad.

Figure 6:
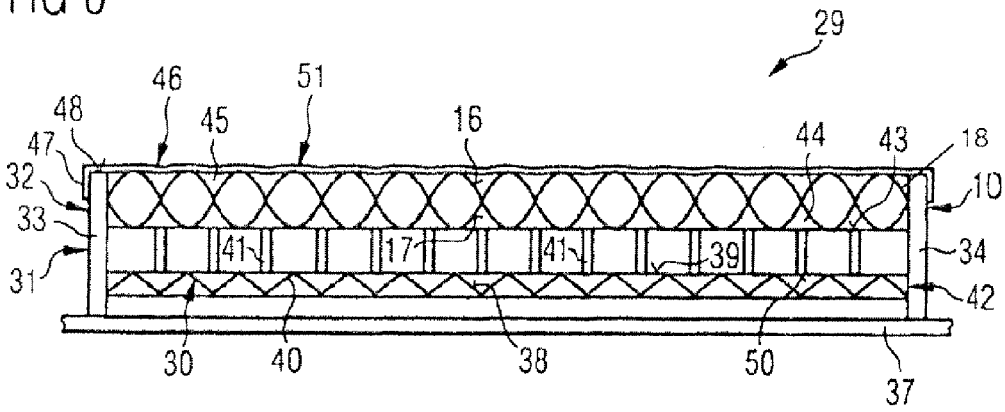
FIG. 6 shows a bed pad design, comprising an antidecubital underlay pad in a sectional diagram.
Figure 7:
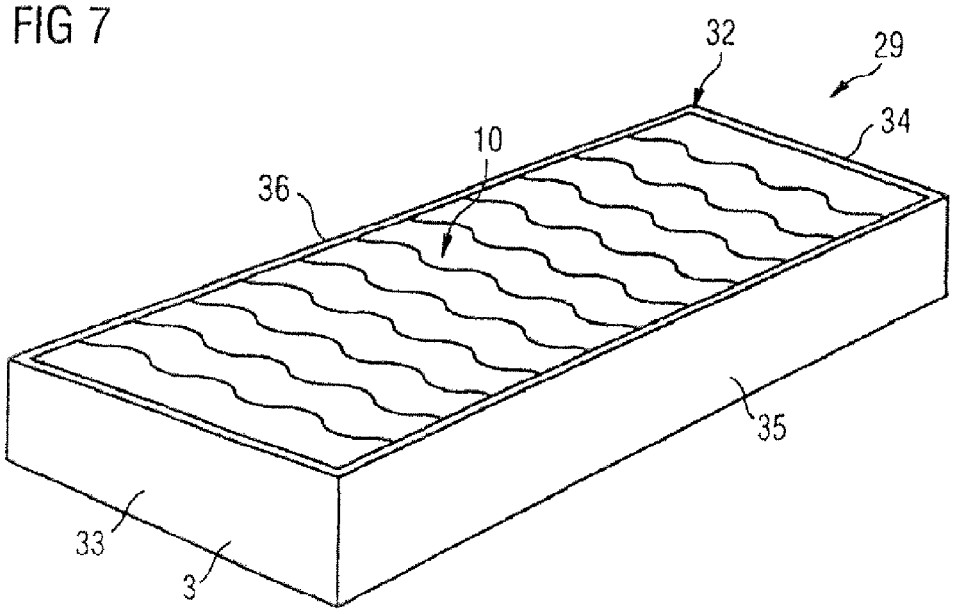
FIG. 7 shows the underlay bed pad in a perspective view.

FIGS. 6 and 7 show a bed pad design 29 produced using the antidecubital underlay pad 10 illustrated in FIGS. 1 and 2. Besides the antidecubital underlay pad 10, the bed pad design 29 includes a supporting layer 30, the antidecubital underlay pad 10 being arranged thereon with an intermediate layer 31 in between. The bed pad design 29 has transverse frame parts 33 and 34 and longitudinal frame parts 35 and 36 connected to the intermediate layer 31 to form a supporting frame 32. The longitudinal frame parts 35, 36 in the present case consist of foam parts which are arranged on the longitudinal sides of the intermediate layer 31. The transverse frame parts 33, 34 in the present case consist of molded parts provided with a three-dimensional network structure, arranged on the transverse sides of the intermediate layer 31. The supporting frame 32, as shown schematically in FIG. 6, serves to be arranged on a bed frame 37. Between the bed frame 37 and the intermediate layer 31 there is the supporting layer 30 in a supportive arrangement, its top side 38 being provided with a structured surface 39 of pyramid-shaped elastically resilient supporting protrusions 40. The intermediate layer 31, which is also made of foam, has ventilation openings 41 that are designed as through-holes and which allow an air exchange between an aeration cavity 42 formed between a bottom side 50 of the intermediate layer 31 and the structured surface 39 of the supporting layer 30 and the underside 17 of the casing of the antidecubital underlay pad 10. An air exchange between the aeration cavity 42 and a lower ventilation space 44 formed between the bottom side 17 of the casing and the top side 43 of the intermediate layer 31 and the room air surrounding the bed pad design 29 is made possible by the transverse frame parts 33, 34 which are designed as spatially interlinked molded structure parts, as already explained above.

As FIG. 6 also shows, the antidecubital underlay pad 10 is arranged in a receiving space 45 formed by the intermediate layer 31 and the transverse frame parts 33, 34 framing the intermediate layer 31 and the longitudinal frame parts 35, 36. The top side 16 of the receiving casing 18 of the antidecubital underlay pad 10 is covered by a cover 46 which is designed like a sheet and in the present case is secured to a top edge 48 of the receiving frame 32 at a peripheral edge area 47. In an overlap area with the top side 16 of the casing, the cover 46 has a cover area 51 which is enlarged in size in comparison with the surface area of the top side 16 of the casing. This ensures that the load areas of the cover area 51 can execute movements parallel to the top side 16 of the casing in relation to the top side 16 of the casing without resulting in any significant tensile stresses in the material of the cover area 51.

What is claimed:

1. A bed pad design comprising an antidecubital underlay pad, having an intermediate layer arranged between a supporting layer and the antidecubital underlay pad, such that the intermediate layer is arranged on a structured surface of the supporting layer forming aeration cavities in cooperation with the intermediate layer and has ventilation openings between a top side of the intermediate layer facing the antidecubital underlay pad and a bottom side of the intermediate layer facing the structured surface of the supporting layer, the antidecubital underlay pad having a receiving casing with a top side of the casing and a bottom side of the casing, the casing being segmented along a plurality of segmentation axes to form underlay segments, such that the underlay segments are provided with a molded body filling comprising a plurality of molded bodies and are bordered by segmentation lines running along the segmentation axes, the segmentation lines having multiple changes in direction in their course along the segmentation axes and at least the top side of the casing is designed to be elastic at least in a supporting area and is prestressed by the molded body filling.

2. The bed pad design according to claim 1,
characterized in that
the supporting layer is formed by a foam material.

3. The bed pad design according to claim 1,
characterized in that
the intermediate layer is formed by a foam material with through-holes formed therein.

4. The bed pad design according to claim 1,
characterized in that
the supporting layer and the intermediate layer arranged thereon are arranged in a layer composite which has frame parts arranged on the longitudinal sides and the transverse sides of the intermediate layer, which frame parts in cooperation with the intermediate layer define a receiving space to receive the antidecubital underlay pad.

5. The bed pad design according to claim 4,
characterized in that
at least two opposing frame parts are made of foam.

6. The bed pad design according to claim 4,
characterized in that
at least two opposing frame parts have an interlinked supporting structure.

* * * * *